US007709718B2

(12) United States Patent
Osuga

(10) Patent No.: US 7,709,718 B2
(45) Date of Patent: May 4, 2010

(54) ELECTRONIC MUSICAL INSTRUMENT KEYBOARD APPARATUS

(75) Inventor: Ichiro Osuga, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 5 days.

(21) Appl. No.: 12/167,395

(22) Filed: Jul. 3, 2008

(65) Prior Publication Data

US 2009/0007756 A1 Jan. 8, 2009

(30) Foreign Application Priority Data

Jul. 4, 2007 (JP) ..... 2007-176173

(51) Int. Cl.
*G10C 3/12* (2006.01)

(52) U.S. Cl. ..... 84/423 R

(58) Field of Classification Search ..... 84/423 R, 84/433, 432, 438

See application file for complete search history.

(56) References Cited

U.S. PATENT DOCUMENTS

2008/0017016 A1* 1/2008 Toyama ..... 84/439

FOREIGN PATENT DOCUMENTS

| | | | |
|---|---|---|---|
| JP | 9198037 | | 7/1977 |
| JP | 8016153 | | 1/1996 |
| JP | 2008145947 | A * | 6/2008 |

* cited by examiner

*Primary Examiner*—Kimberly R Lockett
(74) *Attorney, Agent, or Firm*—Morrison & Foerster LLP

(57) ABSTRACT

Keyboard apparatus includes: a plurality of white and black keys: a plurality of mass body units each pivotable in response to operation of a corresponding one of the keys; a frame having mounted thereon the plurality of keys and mass body units; and upper- and lower-limit stoppers provided on the frame for limiting a pivotable range of each of the mass body units by the mass body unit colliding against the stoppers. Each of the mass body units includes a cavity portion provided in a section thereof that pivots against a gravitational force as the corresponding key is depressed, and a plurality of particles are accommodated in the cavity portion with some vacant space left in the cavity portion.

5 Claims, 4 Drawing Sheets

ELECTRONIC MUSICAL INSTRUMENT KEYBOARD APPARATUS

BACKGROUND

The present invention relates generally to electronic musical instrument keyboard apparatus including a mechanism for causing a mass body unit to pivot in response to depression operation of a corresponding key.

Heretofore, there have been known electronic musical instrument keyboard apparatus of a type in which a mass body unit is caused to pivot in response to depression of a key to provided a key touch feeling, i.e. feeling of mass and feeling of stop, similar to those provide by a keyboard mechanism of an acoustic piano (see, for example, Japanese Patent Application Laid-open Publication No. HEI-9-198037, which will hereinafter be referred to as "patent literature 1").

FIG. 6 is a schematic right side view of a conventionally-known electronic musical instrument keyboard apparatus, which includes white keys 1, black keys 2 and a key frame 61. The key frame 61 has stepped portions formed at front and rear ends regions thereof as viewed in a longitudinal direction of the keys, and a horizontal portion 61*a* located between the front and rear stepped portions. Key support section 61*b* is provided on a rear region of the horizontal portion, and a mass body unit support portion 61*c* is provided on a front region of the underside of the horizontal portion 61*a*. Key pivot portions 1*b* and 2*b* of the white and black keys 1 and 2 are provided on the key support section 61*b* for pivotably supporting the white and black keys 1 and 2. Front and rear mounting portions 61*d* and 61*e* are provide in front of and at the back of the front and rear stepped portions, respectively and mounted to a bottom plate 4 of the key frame. The bottom plate 4 is, for example, a lower case (shelf plate) of the electronic musical instrument. Vertical wall portion 61*f* is formed in front of the mounting portion 61*d*, and a key guide 5 corresponding to the white key 1 is provided on the vertical wall portion 61*f*. The key guide 5 is inserted in the underside of the white key 1 near the distal end la of the key 1 and functions to prevent leftward/rightward positional displacement and rolling of the white key 1. Further, a key guide 6 corresponding to the black key 2 is provided on and projecting upward from the horizontal portion 61*a*. A plurality of key switches 4 are provided on the horizontal portion 61*a* of the key frame, and a plurality of protrusions (actuators) are provided on the undersides of upper portions of the white and black keys 1 and 2 in opposed relation to the key switches 4.

Force transmitting portion 1*c* projects downwardly from the underside of the white key 1 and passes through a hole 61*g* of the horizontal portion 61*a*. The force transmitting portion 1*c* has a bottom plate provided at its distal end. Resilient member 7 is fixed to the lower surface of the bottom plate.

Mass body units 62 are provided in corresponding relation to the white keys 1 and black keys 2. The mass body units 62 are arranged under the keys 1 and 2 in parallel to one another under in a direction where the keys are arranged in parallel to one another (i.e., i.e., in a key-arranged direction). The mass body unit 62 shown in the figure corresponds to the white key 1. Each of the mass body units 62 is pivotably supported by the support portion 61*c*, and it is caused to pivot via the corresponding force transmitting portion 1*c*.

Each of the mass body units 62 includes: a pivot point portion 62*c* supported by the mass body unit support portion 61*c*; main and auxiliary driven portions 62*a* and 62*b* of a bifurcated shape formed in front of the pivot point portion 62*c* and engageable with the force transmitting portion 1*c* of the corresponding key; an elongated connecting section 62*d* located rearwardly of the pivot point portion 62*c*; and a mass concentrating section 62*d* provided at the rear end of the elongated connecting section 62*e*. Namely, the elongated connecting section 62*d* is joined to an upper front end portion of the mass concentrating section 62*e*. The mass concentrating section 62*d* and mass concentrating section 62*e*, especially the mass concentrating section 62*e*, produce a great moment of inertia as the mass body unit 62 pivots.

The mass concentrating section 62*e* has a horizontal lower surface portion that can uniformly collide against a later-described lower-limit stopper 9. The mass concentrating section 62*e* also has an upper surface portion slanting downward toward its rear end, and this upper surface portion can uniformly collide against a later-described upper-limit stopper 10. The above-mentioned main and auxiliary driven portions 62*a* and 62*b* are held in engagement with the force transmitting portion 1*c* with the resilient member 7 interposed therebetween.

As the mass body unit 62 pivots in response to key depression operation by a human player, a reactive force corresponding to a moment of inertia of the mass body unit 62 is transmitted via the white key 1, so that a feeling of mass is imparted to a player's finger having depressed the key. Then, once the human player releases the finger from the depressed white key 1, the mass body unit 62 slowly pivots back to the original position (i.e., position illustrated in the figure).

Although not specifically shown, the force transmitting portion of the black key 2 overlaps the force transmitting portion 1*c* of the white key 1 as viewed in a direction perpendicular to the sheet of the figure. Mass body unit similar to that for the white key 1 is provided for the black key 2, and pivotably supported by the mass body unit support portion so that it can pivot via the force transmitting portion of the black key 2. Although not shown in the figure, a return spring is provided between each of the white and black keys 1 and 2 and the key frame 61.

The upper-limit stopper 10 is disposed on the lower surface of the horizontal portion 61*a* of the key frame. As the mass body unit 62*e* pivots, the upper surface of the mass concentrating section 62*e* collides with the stopper 10 to be stopped at an upper limit position defined by the stopper 10. Because the mass concentrating section 62*e* is rapidly braked, a human player's finger is imparted with a feeling of stop by way of the key.

The lower-limit stopper 9 is disposed on the upper surface of the bottom plate 4 of the key frame. As the mass body unit 62 pivots back to the initial position, the lower surface of the mass concentrating section 62 collides with the stopper 9 to be stopped at the initial position defined by the stopper 9. At this time too, a feeling of stop can be imparted to the human player's finger as long as it is kept in contact with the key.

Further lower-limit stopper 11 is disposed on a front upper surface of the horizontal portion 61*a* of the key frame. Once the white key 11 is fully depressed after the key switch 11 turns ON, the white key 1 is stopped at a lower limit position by left and right side surfaces of the white key 1 colliding with the further lower limit stopper 11. Such lower-limit stopper 9, upper-limit stopper 10 and further lower-limit stopper 11 each extend in a belt shape in the key-arranged direction for shared use among all of the white and black keys.

From the viewpoints of an impact absorbing capability, tone deadening capability and improved reproducibility of the stopped positions of the keys (white and black keys 1 and 2) and mass body units 62, the above-mentioned stoppers 9, 10 and 11 need to have a resilient restoring force; it has been conventional to form these stoppers 9, 10 and 11 of, for example, felt, polyurethane elastomer or the like. However, it has been known that resilient deformations are accumulated in the stoppers 9, 10 and 11 as they are compressed due to an impact applied from the mass body unit 62 and such resilient deformations would cause a reactive force (called "rebound") to the key and mass body unit 62 such that the key would undesirably vibrate. Thus, there can not be obtained a comfortable feeling of stop. Particularly, a great reactive force would be given by the upper-limit stopper 10 that is subjected to an impact from the mass body unit 62 having pivoted by being subjected to a great key depression pressure.

Also known in the art are electronic musical instrument keyboard apparatus in which each mass body unit has a closed interior space and a multiplicity of fine weight particles are movably accommodated in the closed interior space (see. for example, Japanese Patent Application Laid-open Publication No. HEI-8-16153, which will hereinafter be referred to as "patent literature 2"). In contrast to the aforementioned electronic musical instrument keyboard apparatus, the closed interior space swings vertically downward in response to depression of the corresponding key. Thus, at the beginning of strong key depression (i.e., key depression with a great force), the fine weight particles freely fall, which produces a small inertial mass. During the pivotal movement of the mass body unit, the mass of the fine weight particles is added to the mass body unit, so that a human player can obtain a feeling of performance. Once the mass body unit collides against the lower-limit stopper, the reactive force to the human player's finger becomes very small not only because the fine weight particles function to attenuate the collision energy of the mass body unit but also because the weight of the key has decreased due to the collision. As the mass body unit pivots back into collision against the upper-limit stopper, the reactive force becomes small on the same principle as noted above so that the mass body can stop without bounding.

However, with such known electronic musical instrument keyboard apparatus, it has been difficult to greatly vary the feeling of mass during key depression operation. Besides, no effective techniques have been proposed to date for preventing mechanical sound noise from being produced by the movement of the fine weight particles and for knowing the accommodated quantity of the fine weight particles in the closed inner space of the mass body unit.

SUMMARY OF THE INVENTION

In view of the foregoing, it is an object of the present invention to provide an improved electronic musical instrument keyboard apparatus which includes mass body units each pivotable in response to depression operation of a corresponding key, and which can not only increase a feeling of mass at the beginning of the key depression operation but also vary the feeling of mass of the key during the key depression operation.

In order to accomplish the above-mentioned object, the present invention provides an improved electronic musical instrument keyboard apparatus, which comprises: a plurality of keys: a plurality of mass body units each pivotable in response to operation of a corresponding one of the keys; a frame having mounted thereon the plurality of keys and the plurality of mass body units in parallel to one another; and movement limiting members provided on the frame for limiting a pivotable range of each of the mass body units by the mass body unit colliding against the movement limiting members. In the present invention, each of the mass body units includes a cavity portion in a section thereof that pivots against a gravitational force as the corresponding key is depressed, and a plurality of particles are accommodated in the cavity portion with a vacant space left in the cavity portion.

At the beginning of depression, with a human player's finger, of any one of the keys, the section of the corresponding mass body unit, including the cavity portion, swings against the gravitational force, and thus, the particles accommodated in the cavity portion are driven against the gravitational force. Thus, the feeling of mass imparted from the mass body unit to the human player's finger via the key increases in accordance with a moment of inertia given from the particles to the mass body unit. Because the vacant space is provided in the cavity portion, the particles are subjected to a centrifugal force and move away from a pivot point portion of the mass body unit during the key depression operation. The moment of inertia given from the particles to the mass body unit increases in proportion of a square of a distance from the pivot point portion of the mass body unit to a particular position of the particles. As a consequence, the moment of inertia of the entire mass body unit, including the plurality of particles, increases in response to the pivoting movement, which can therefore vary the feeling of mass of the key to be imparted from the mass body unit to the human player's finger via the key.

In an embodiment of the present invention, a shock absorbing member is provided within the cavity portion, which can reduce mechanical sound noise that would be produced by the particles colliding directly against the inner surface of the cavity portion.

In an embodiment of the present invention, each of the particles is coated with a soft material. Because the bodies of the particles collide against the inner surface of the cavity portion via the soft material, it is possible to mechanical sound noise produced by the particles colliding against the inner surface of the cavity portion.

In an embodiment of the present invention, each of the mass body units includes left and right side wall portions arranged in a key-arranged direction, the cavity portion is defined between the left and right side wall portions, and at least one of left and right side wall portions has optical transparency. Thus, it is possible to visually check the quantity and status of the particles accommodated in the cavity portion. The side wall portion may have such optical transparency only in part thereof rather than the whole area thereof.

In an embodiment of the present invention, at least one of the left and right side wall portions not only has the optical transparency but also has one or more scale marks. Because it is possible to accommodate the particles in the cavity portion while measuring the quantity of the particles to be accommodated in the cavity portion using the scale marks as a visual guide, the mass body unit can be assembled with an enhanced efficiency during manufacture. The scale marks may be put on the optical transparent area of the side wall portion, or each of the scale marks may be made of an optical transparent material with a region surrounding the scale mark made of an opaque material.

With the aforementioned inventive electronic musical instrument keyboard apparatus including the mass body units each pivotable in response to operation, with a human player's finger, of a corresponding one of the keys, not only the feeling of mass felt by the human player's finger at the beginning of the key depression operation can be increased, but also the feeling of mass of the key can be varied during the depression operation. At that time, the present invention can also prevent production of mechanical sound noise and permits visual check of the accommodated quantity of the particles and enhanced assembling efficiency.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION

Figure 1A:
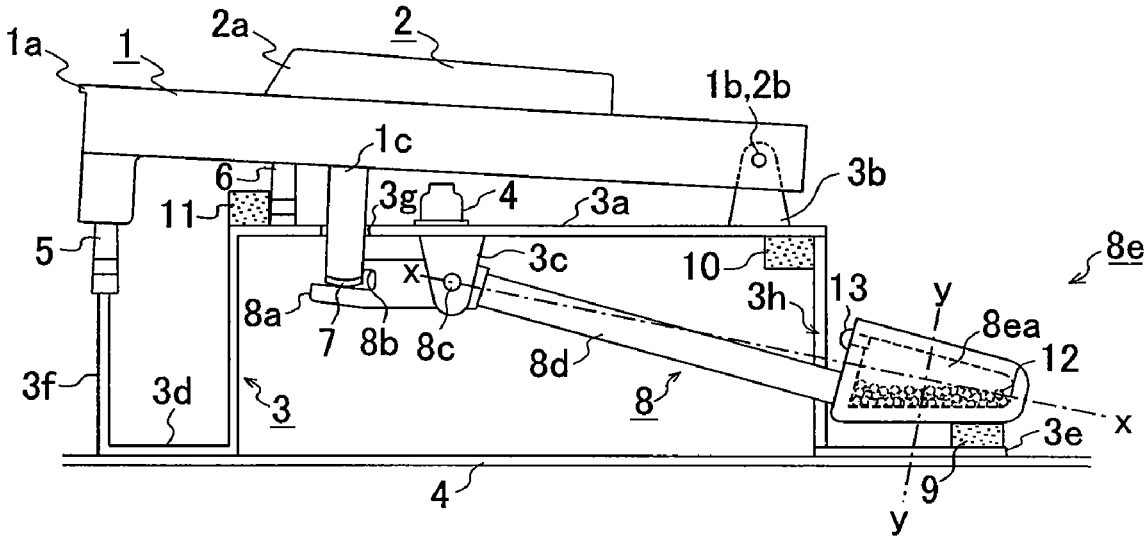
FIGS. 1A and 1B are right side views schematically showing an electronic musical instrument keyboard apparatus according to an embodiment of the present invention.
Figure 1B:
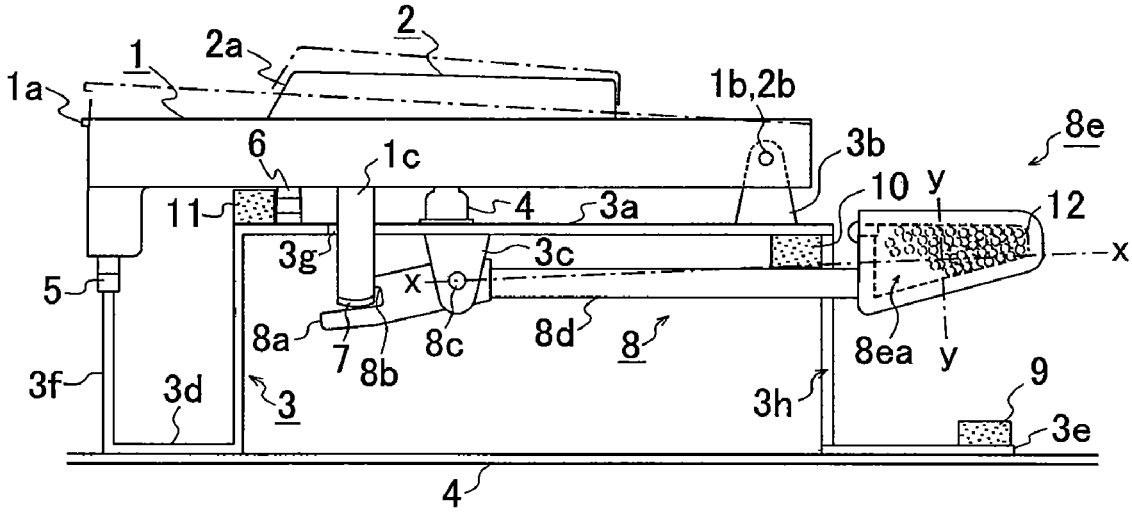
Figure 6:
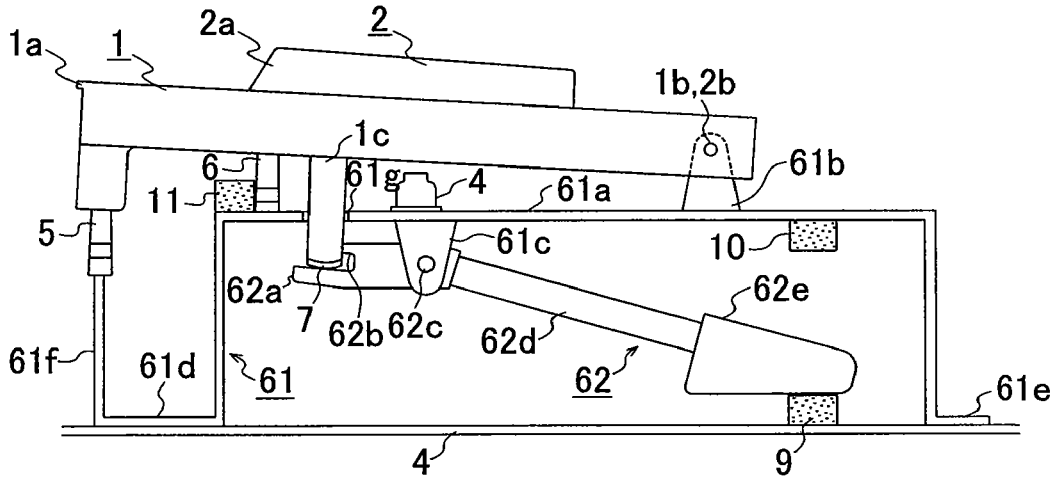
(PRIOR ART) FIG.6
FIG. 6 is a schematic right side view of a conventionally-known electronic musical instrument keyboard apparatus.

FIGS. 1A and 1B are right side views schematically showing an electronic musical instrument keyboard apparatus according to an embodiment of the present invention. In these figures, similar elements to those in FIG. 6 are indicated by the same reference numerals and characters as in FIG. 6. In FIGS. 1A and 1B, reference character 3 indicates a key frame that is constructed in practically the same manner as the key frame 61 shown in FIG. 6. Elements indicated by 3*a*-3*g* in FIGS. 1A and 1B correspond to the elements 61*a*-61*g* in FIG. 6. The horizontal portion 3*a*, which is shorter than the horizontal portion 61*a* of FIG. 6, has a slit 3*h* formed in a rear stepped portion of the key frame 3.

FIG. 1A shows an initial state where a white key 1 is in a non-depressed position, while FIG. 1B shows a state where the white key 1 is in a depressed position with a corresponding mass body unit 8 retained by an upper-limit stopper (movement limiting member) 10. In FIG. 1B, a black key 2 is also in a depressed position.

In FIGS. 1A and 1B, the mass body unit 8 corresponding to the white key 1 includes main and auxiliary driven portions 8*a* and 8*b* of a bifurcated shape, pivot point portion 8*c*, connecting section 8*d* and mass concentrating section 8*e*, similarly to the mass body unit 62 shown in FIG. 6.

Namely, the electronic musical instrument keyboard apparatus according to the instant embodiment of the present invention includes, a plurality of the white and black keys 1 and 2, a plurality of the mass body units 8 each pivotable in response to depression operation of a corresponding one of the keys, key frame 3 on which the plurality of keys and mass body units 8 are mounted in parallel relation to one another, and lower-limit and upper-limit stoppers (movement limiting members) 9 and 10 fixed to the key frame 3 to limit the pivoting range of each of the mass body units 8 by abutting engagement with the mass body unit 8 (i.e., by the mass body unit 8 colliding against the stoppers 9 and 10). The key frame 3 pivotably supports thereon the white and black keys 1 and 2 on the key support section 3*b* and pivotably supports thereon the mass body units 8 on the mass body unit support section 3*c*.

Once the corresponding key (white key 1 in the illustrated example of FIG. 1B) is depressed, the mass concentrating section 8*e* swings against the gravitational force, i.e. in a direction including a vertically upward component. The mass concentrating section 8*e* has a cavity portion 8*ea* in which a plurality of particles 12 are accommodated with some vacant space left.

In the figures, each two-dot-dash line x-x represents a line extending along a radius of a pivoting trajectory of the mass body unit 8 (i.e., radial direction) and interconnecting the pivot point portion 8*c* and an interior position (i.e., substantial center point) of the cavity portion 8*ea* (i.e., radial direction in which a distance from the pivot point portion 8*c* increases or decreases), and each two-dot-dash line y-y represents an upward or downward pivoting direction of the interior position (i.e., substantial center point) of the cavity portion 8*ea*.

The cavity portion 8*ea* extends in the pivoting direction y-y so that the plurality of particles 12 can move in the pivoting direction y-y within the cavity portion 8*ea*, and it also extends in the radial direction x-x of the pivoting trajectory so that the plurality of particles 12 can move in the radial direction x-x within the cavity portion 8*ea*.

Because the mass concentrating section 8*e* in the instant embodiment has the cavity portion 8*ea* of a relatively great size proportional to its contour, the mass concentrating section 8*e* is formed into a greater contour than the mass concentrating section 62*e* of FIG. 6. Besides, the connecting section 8*d* of the mass body unit 8 is formed into a greater length than the connecting section 62*d* of FIG. 6 so that the mass body unit 8 has the same pivoting range (stroke range) as the mass body unit 62 of FIG. 6.

The connecting section 8*d* has a rear portion passed through the slit 3*h* formed in the rear stepped portion of the key frame 3, and the mass concentrating section 8*e* is located rearwardly of the key frame 3. During pivoting movement of the mass body unit 8, the upper surface of a near-rear-end portion of the connecting section 8*d* moves vertically upward into abutting contact or collision with the upper-limit stopper 10, or the lower surface of the mass concentrating section 8*e* moves vertically downward into abutting contact or collision with the lower-limit stopper 9.

As shown, the connecting section 8*d* is fixedly joined to a lower front end portion of the mass concentrating section 8*e*, so that, even where the mass concentrating section 8*e* has a shape raised vertically upward, the height of the mass body unit 8 in the upper limit position can be effectively limited.

Whereas the mass concentrating section 8*e* and cavity portion 8*ea* are each shaped to have a greater length in the radial direction x-x than in the pivoting direction y-y.

Figure 2A:
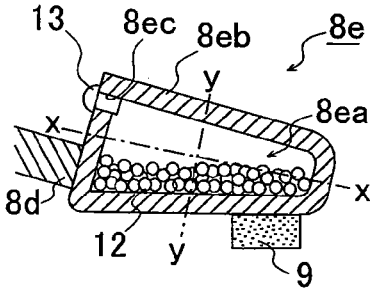
FIGS. 2A-2C are sectional views schematically showing distribution states of particles within a cavity portion shown in FIGS. 1A and 1B.
Figure 2B:
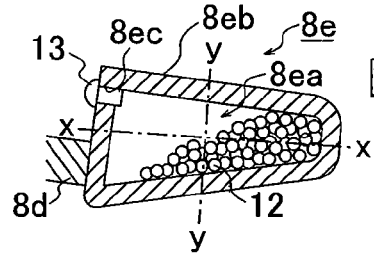
Figure 2C:
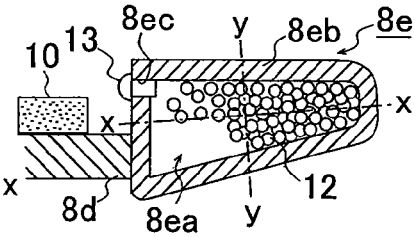

FIGS. 2A-2C are sectional views schematically showing distribution states of the particles within the cavity portion 8*ea* shown in FIGS. 1A and 1B. More specifically, the cavity portion 8*ea* is surrounded by an outer wall 8*eb*, and a particle-introducing path 8*ec* is formed through a portion of the outer wall 8*eb* immediately above the front end portion of the mass concentrating section 8*e* where the connecting section 8*d* is fixedly joined. The plurality of particles 12 are introduced through the introducing path 8*ea* into the cavity portion 8*ea* and then enclosed within the cavity portion 8*ea* by the introducing path 8*ec* being closed with a closing member 13, such as a screw, plug or sealant, so that the particles 12 do not scatter out of the cavity portion 8*ea* through the introducing path 8*ec*.

The quantity of the particles 12 to be accommodated in the cavity portion 8*ea* is adjusted so that a sufficient vacant space to permit free movement of the particles 12 within the cavity portion 8*ea* is left in the cavity portion 8*ea*. Thus, the particles 12 are stored practically uniformly on the inner bottom of the cavity portion 8*ea*.

The main and auxiliary driven portions 8*a* and 8*b* and pivot point portion 8*c* are integrally formed of synthetic resin or the like, to provide a base section of the mass body unit 8. For example, the base section is outsert-molded with the connecting section 8*d*, for example formed of metal, inserted in a mold. The mass concentrating section 8*e* may be formed integrally with the connecting section 8*d*.

As with the mass body unit disclosed in patent literature 1 discussed above, the cavity portion 8*ea* of the mass concentrating section 8*e* may be formed by fitting together a first case and a second case functioning as a lid. As in another embodiment of the present invention to be later described with reference to FIGS. 4A-4C, the mass concentrating section 8*e* may be provided by attaching side wall portions to a core member that is integrally formed with the connecting section 8*d* and has an inner closed region functioning as the cavity portion.

The particles 12 are in the form of solid pieces; although the particles 12 are each shown as having a spherical shape, they may be of any other suitable shape. It is desirable that each of the particles 12 have an outer diameter of 3 mm or less. Although the particles 12 may be sand or iron or lead particles as disclosed in patent literature 2 discussed above, they may be particles of another type of metal, ceramic or plastic material.

Once a human player starts depressing any one of the white and black keys 1 and 2 with a finger, the corresponding mass body unit 8 pivots counterclockwise so that the section where the cavity portion 8*ea* is provided swings or moves upward against the gravitational force; thus, the particles 12 accommodated in the cavity portion 8*ea* are driven against the gravitational force.

As a consequence, the gravitational force applied to the particles 12 and reactive force to the driving force imparted from the inner bottom surface of the cavity portion 8*ea* are applied to the inner bottom surface of the cavity portion 8*ea*, so that the particles 12 give a moment of inertia to the mass body unit 8. Feeling of mass given from the mass body unit 8 to the human player's finger via the key increases in accordance with the moment of inertia. If the key is depressed with a greater force, the feeling of mass increases.

FIG. 2B is explanatory of distribution of the particles 12 in the middle of the pivoting movement of the mass body unit 8 responsive to depression of a corresponding one of the white keys 1 with a human player's finger. During the course of the pivoting movement of the mass body unit 8, a feeling of mass corresponding to moments of inertia of the connecting section 8*d* and mass concentrating section 8*e* is given from the white key 1 to the human player's finger.

Because the particles 12 are subjected to a driving force from the inner bottom surface of the cavity portion 8*ea* upward in the pivoting direction y-y and subjected to a centrifugal force acting outwardly in the radial direction x-x of the pivoting trajectory, the center of gravity of the particles 12 moves away from the pivot point portion 8*c* toward the rear end of the mass body unit 8. As a consequence, the moment of inertia given from the particles 12 to the mass body unit 8 increases in response to the pivoting movement, which can vary the feeling of mass of the key that is imparted from the mass body unit 8 to the human player's finger via the key.

Here, if the key is depressed with a greater force, the movement of the particles 12 within the cavity portion 8*ea* is promoted so that the moment of inertia increases prominently. On the other hand, if the key is depressed with a smaller force to cause the mass body unit 8 to pivot more slowly, the center of gravity of the particles 12 would return toward the pivot point portion 8*c*, rather than toward the rear end, so that the feeling of mass decreases.

FIG. 2C is explanatory of distribution of the particles 12 immediate after collision, against the upper-limit stopper 10, of the mass body unit 8. Because the particles 12 have so far been driven in the counterclockwise pivoting direction y-y and there is the vacant space in the cavity portion 8*ea*, the particles 12 not only collide against the inner surface, such as the ceiling surface, of the cavity portion 8*ea* but also collide against one another once the mass body unit 8 collides against the upper-limit stopper 10. At that time, part of motion energy of the particles 12 changes into heat. Namely, only part of the motion energy of the particles 12 changes into elastic energy or resilience of the upper-limit stopper 10, and thus, in this case, the reactive force given from the upper-limit stopper 10 as the upper-limit stopper 10 emits elastic energy does not increase so much as compared to a case where no particle 12 is contained in the cavity portion 8*ea*. As a consequence, even though the feeling of mass increases by virtue of the particles 12, the feeling of stop imparted to the human player's finger would not degrade.

Assuming that the particles 12 are fixed to the cavity portion 8*ea* contrary to the foregoing, the motion energy of the particles 12 would not be consumed within the cavity portion 8*ea*, and thus, the reactive force produced when the upper-limit stopper 10 emits elastic energy increases in accordance with the total mass of the particles 12. As a consequence, the feeling of discomfort imparted to the human player's finger would undesirably increase.

Once the human player releases the white key 1 (key release operation), the mass body unit 8 pivots clockwise through the action of the gravitational force, so that the initial state of FIG. 2A is restored. Because the particles 1 slowly fall in the clockwise pivoting direction y-y by virtue of its weight together with the mass concentrating section 8*e*, the particles 12 collide against the inner surface of the cavity portion 8*ea* and collide against one another once the mass body unit 8 collides against the lower-limit stopper 9. At that time, at least part of the motion energy of the particles 12 changes into heat, so that, as when the mass concentrating section 8*e* collides against the upper-limit stopper 10, the reactive force given from the lower-limit stopper 9 does not increase so much as compared to the case where no particle 12 is contained in the cavity portion 8*ea*.

Figure 3A:
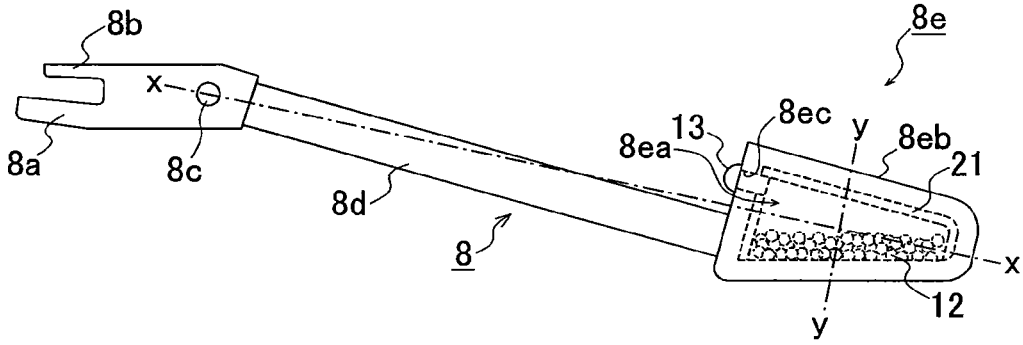
FIGS. 3A and 3B are views schematically showing a modification of the embodiment shown in FIGS. 1A and 1B.
Figure 3B:
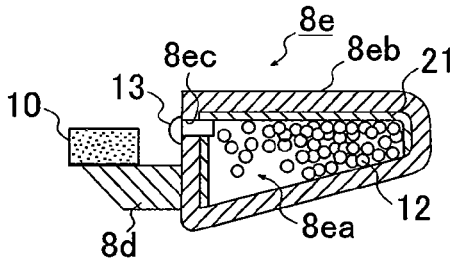

FIGS. 3A and 3B are views schematically showing a modification of the embodiment shown in FIGS. 1A and 1B. In these figures, similar elements to those in FIGS. 1A and 1B are indicated by the same reference numerals and characters as in FIGS. 1A and 1B. Generally the same mass body units 8 as shown in FIGS. 1A-2C are employed in the modification, but the modification is characterized in that a shock absorbing members 21 are provided within the cavity portion 8*ea*. The shock absorbing member 21 only has to be provided on at least part of the inner surface of the cavity portion 8*ea*. Further, the shock absorbing member 21 may be fixed to the inner surface of the cavity portion 8*ea* or integrally molded, by two-color molding, together with the mass concentrating section 8*e*. Alternatively, the shock absorbing member 21 may be merely movably accommodated in the interior space of the cavity portion 8*ea* together with the particles 12. In this case, at least part of the particles 12 collide against the inner surface of the cavity portion 8*ea* via the shock absorbing member 21, and thus, it is possible to reduce mechanical sound noise that would be produced by the particles 12 colliding directly against the inner surface of the cavity portion 8*ea*. The shock absorbing member 21 may be made of felt, rubber, elastomer, sponge (spongy material formed of rubber or synthetic resin), nonwoven cloth, flexible polyvinyl chloride, string or the like.

In the illustrated example of FIGS. 3A and 3B, the shock absorbing member 21 is disposed on the ceiling surface and front and rear end inner surfaces of the cavity portion 8*ea*. The shock absorbing member 21 may also be disposed the inner surfaces of left and right side wall portions arranged in parallel to each other in the key-arranged direction. The shock absorbing member 21 may comprise a plurality of divided pieces. Because the particles 12 violently collide against the inner surface (ceiling surface) located ahead in the pivoting direction once the mass concentrating section 8*e* collides against the upper-limit stopper 10 in response to the key depression operation, providing the shock absorbing member 21 on the ceiling surface of the cavity portion 8*ea* will be highly effective. The shock absorbing member 21 has a hole corresponding in position to the introducing path 8*ec*, or no such shock absorbing member 21 is provided where the introducing path 8*ec* is located.

The shock absorbing member 21 is provided in the cavity portion 8*ea*, in the illustrated example of FIGS. 3A and 3B. Alternatively, the particles 12 may be coated with a soft material so that the bodies of the particles 12 do not collide directly against the inner surface of the cavity portion 8*ea*, to thereby prevent production of mechanical sound noise. The soft material may be rubber, elastomer, flexible polyvinyl chloride or the like.

Figure 4A:
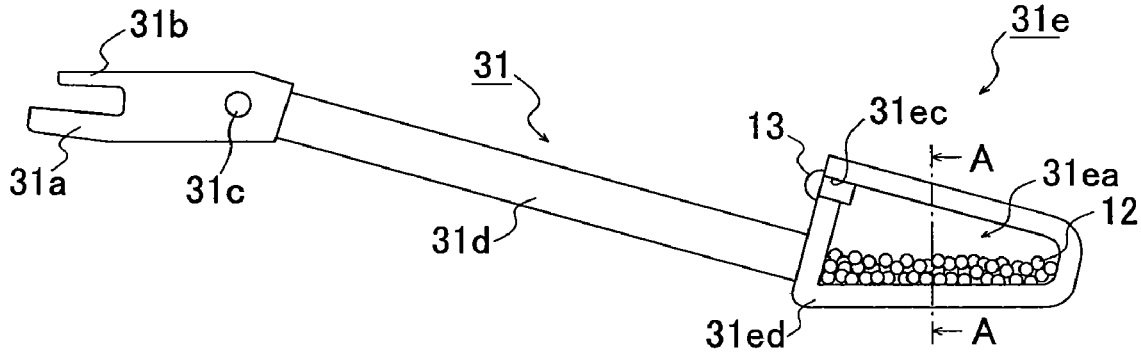
FIGS. 4A-4C are views schematically showing a construction of another embodiment of a mass body unit.
Figure 4B:
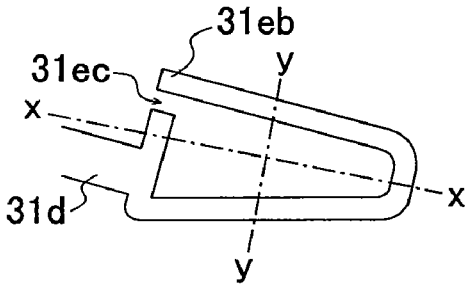
Figure 4C:
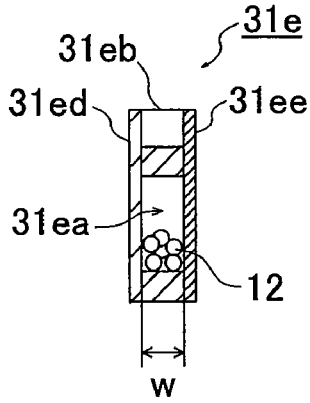

FIGS. 4A-4C are views schematically showing a construction of another embodiment of the mass body unit 31. More specifically, FIG. 4A is a right side view showing an entire construction of the mass body unit 31, FIG. 4B is a right side view showing the connecting section 31*d* and core member 31*eb* integrated with each other, and FIG. 4C is a cross-sectional view of the mass concentrating section 31*e* taken along the A-A line of FIG. 4A.

Except for a construction of the mass concentrating section 31, the mass body unit 31 is similar in construction to the mass body unit 8 shown in FIGS. 1A-2C; therefore, the elements 31*a*-31*d* are similar in construction to the elements 8*a*-8*d*. Cavity portion 31*ea* is formed by constructing the mass concentrating section 31*e* of three components.

As seen in FIG. 4B, the core member 31*eb* has a closed region, which is to be ultimately formed as the cavity portion 31*ea*, in a plane including the radial direction x-x of the pivoting trajectory and pivoting direction y-y of the mass body unit 31. The core member 31*eb* has a width w as shown in FIG. 4C. The particle-introducing path 31*ec* is formed in a front end upper portion of the core member 31*eb*.

As shown in FIG. 4C, the cavity portion 31*ea* is defined by the core member 31*eb* being sandwiched by the right and left side wall portions 31*ed* and 31*ee* along the key-arranged direction.

The cavity portion 31*ea* and connecting section 31*d* can be made as an integral piece through punching of a single plate. The core member 31*eb* and right and left side wall portions 31*ed* and 31*ee* may be integrally molded together, glued together, fastened together, or securely fitted together. As with the mass body unit 8 shown in FIGS. 2A-2C, the main and auxiliary driven portions 8*a* and 8*b*, base section including the pivot point portion 31*c* and connecting section 31*d* are integrated with one another, for example, by outsert-molding.

At least one of the right and left side wall portions 31*ed* and 31*ee* has optical transparency; for this purpose, it may be formed of transparent ABS resin. In the illustrated example, the whole area of the right side wall portion 31*ed* has optical transparency; however, only part of the right side wall portion 31*ed* may have optical transparency. Because the particles 12 accommodated in the cavity portion 31*ea* can be viewed through the optical transparent portion of the side wall portion, it is possible to visually check the accommodated quantity and status (such as a wear status) of the particles 12. The optical transparent portion of the side wall portion need not necessarily be completely transparent and may be translucent, such as milk white.

Figure 5A:
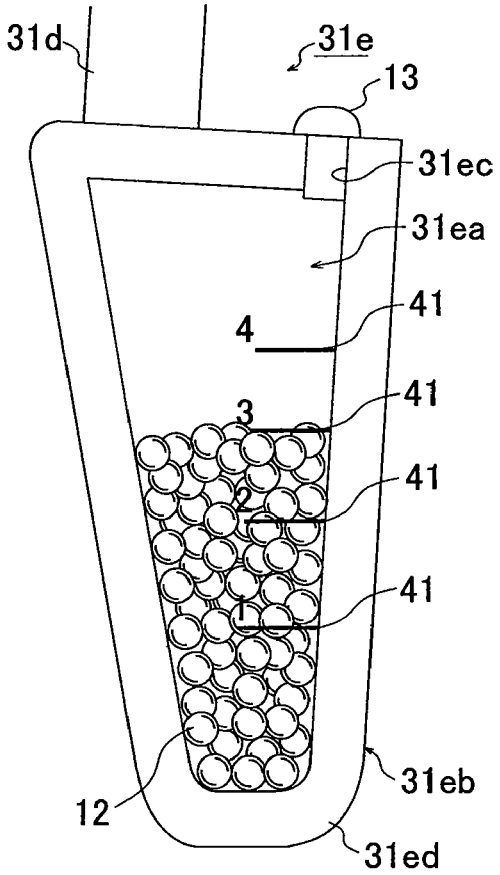
FIGS. 5A and 5B are views schematically showing modifications of the mass body unit shown in FIGS. 4A-4C.
Figure 5B:
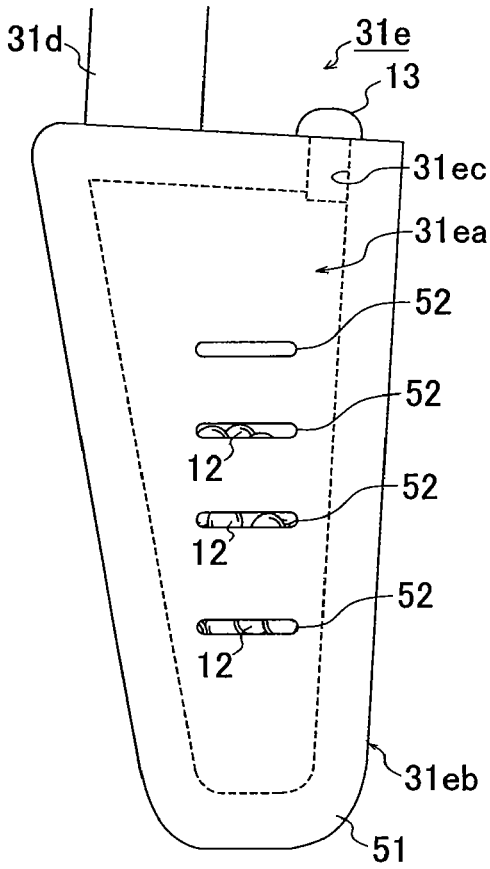

FIGS. 5A and 5B are views schematically showing modifications of the mass body unit 31 shown in FIGS. 4A-4C, where similar elements to those in FIGS. 4A-4C are indicated by the same reference numerals and characters. As shown in FIG. 5A, the right side wall portion 31*ed*, having optical transparency as set forth above in relation to FIG. 4A-4C, has one or more scale marks 41. In addition to the scale marks 41, the right side wall portion 31*ed* has signs or marks, such as numbers, star signs, circle marks and/or the like put thereon, which provide an indication or visual guide of the quantity of the particles 12 within the cavity portion 31*ea*. These scale marks 41 etc. may be made by stamping, printing, scribing, oil-based marker or the like.

When introducing the particles 12 through the introducing path 31*ec* into the cavity portion 31*ea* with the rear end of the mass concentrating section 31*e* positioned to serve as a bottom surface, as shown in the figures, the marks provided on the side wall portion 31*ed* can be used, as a visual guide, to appropriately measure the quantity of the particles 12 to be accommodated in the cavity portion 31*ea*. Further, because the particles 12 can be viewed through regions of the right side wall portion 31*ed* having no marks, such as the scale marks 41, the mass body unit 31 can be assembled with an enhanced efficiency during manufacture.

In the case where the cavity portion 31*ea* is elongated in the radial direction x-x of the pivoting trajectory, it is preferable that the particles 12 be measured with the rear end of the section 31*e* positioned to serve as the bottom surface, because the accommodated quantity and total mass of the particles 12 can be reflected appropriately at an interfacial or boundary height. In this case, the boundary between the particles 12 and the vacant inner space can be readily identified, though comparison with the lies of the scale marks 41, if the scale marks 41 are put in parallel to the rear end surface of the mass concentrating section 31*e*.

In the modification shown in FIG. 5B, the right side wall portion 31*ed* of FIG. 5A is replaced with the right side wall portion 51 which is generally opaque but has opaque transparency only in one or more limited regions thereof. More specifically, the right side wall portion 51 has one or more windows 52 formed of an opaque transparent material. In the illustrated example, the right side wall portion 51 has a plurality of windows 52 in the form of slits parallel to the bottom surface defined by the rear end of the mass concentrating section 31*e*, so that measurement can be readily performed in a similar manner to the above-described measurement using the scale marks 41 shown in FIG. 6A. The windows 52 may be slit-shaped through-holes, in which case, however, the through-holes must each have a limited width such that the particles 12 do not scatter out of the cavity portion 31*ea* through the hole. The windows 52 need not necessarily be in the form of slits and parallel to the rear end of the mass concentrating section 31*e*. Numbers and differently-shaped marks may be put on the right side wall portion 51 as with the right side wall portion 31*ed* of FIG. 5A.

Whereas the mass body units have been described above as having the cavity portion in the mass concentrating section, the cavity portion may be provided in the connecting section, rather than in the mass concentrating section, to accommodate the particles 12. Alternatively, there may be employed further modified mass body units where the mass concentrating section and the connecting section are not clearly divided in shape, and the cavity portion may be provided in a suitable position of each of such mass body units.

Whereas the mass body units have been described above as having the introducing path through which to introduce the particles 12 into the cavity portion. Alternatively, the particles 12 may be introduced into the cavity portion during a manufacturing stage where the cavity portion is still open.

The foregoing have described the feeling of mass imparted by the particles 12 accommodated in the cavity portion; however, because the mass of the connecting section and mass concentrating section (outer wall, core member and side wall portions) too contributes to the moment of inertia of the mass body unit, it is desirable that these sections too be formed of a material having a relatively great specific gravity. Further, because the key touch feeling degrades if the connecting section and mass concentrating section of the mass body unit flex bend, it is desirable that these sections be formed of a material of a relatively great rigidity, such as metal.

The foregoing have described the white and black keys 1 and 2 each of which pivots about the respective fixed key pivot point portion 1*b* or 2*b* in response to depression operation. However, among the conventionally-known electronic musical instrument keyboard apparatus are those where each of the white and black keys pivots about a virtual pivot point or where each such virtual pivot point is located at an indefinite distance and each depressed key pivots in a vertically-downward-translating manner (see, for example, Japanese Patent Application Laid-open Publication No. HEI-4-66995). With such keyboard apparatus too, there can be obtained a feeling of mass and feeling of stop of each operated key by providing a force transmitting portion in association with each key and depressing a driven portion of the mass body unit by means of the force transmitting portion to thereby cause the mass body unit to pivot. Thus, these keyboard apparatus too can attain generally the same behavior and advantageous results by application of the basic principles of the present invention.

This application is based on, and claims priority to, JP PA 2007-176173 filed on 4 Jul. 2007. The disclosure of the priority applications, in its entirety, including the drawings, claims, and the specification thereof, is incorporated herein by reference.

What is claimed is:

1. An electronic musical instrument keyboard apparatus comprising:

a plurality of keys:

a plurality of mass body units each pivotable in response to operation of a corresponding one of the keys;

a frame having mounted thereon said plurality of keys and said plurality of mass body units; and movement limiting members provided on said frame for limiting a pivotable range of each of said mass body units by the mass body unit colliding against said movement limiting members, wherein each of said mass body units includes a cavity portion provided in a section thereof that pivots against a gravitational force as the corresponding key is depressed, and a plurality of particles are accommodated in said cavity portion with a vacant space left in said cavity portion.

2. The electronic musical instrument keyboard apparatus as claimed in claim 1 wherein a shock absorbing member is provided within said cavity portion.

3. The electronic musical instrument keyboard apparatus as claimed in claim 1 wherein each of the particles is coated with a soft material.

4. The electronic musical instrument keyboard apparatus as claimed in claim 1 wherein each of said mass body units includes left and right side wall portions arranged in a key-arranged direction, said cavity portion is defined between the left and right side wall portions, and at least one of left and right side wall portions has optical transparency.

5. The electronic musical instrument keyboard apparatus as claimed in claim 4 wherein at least one of left and right side wall portions not only has the optical transparency but also has one or more scale marks.

* * * * *